United States Patent [19]

Hartig

[11] 4,167,043

[45] Sep. 11, 1979

[54] APPARATUS FOR SECURING A HEARING PROTECTOR TO A PROTECTIVE HELMET

[75] Inventor: Guenter Hartig, Rodenbach, Fed. Rep. of Germany

[73] Assignee: Optac Wilfrid Weltin, Roden, Fed. Rep. of Germany

[21] Appl. No.: 873,675

[22] Filed: Jan. 30, 1978

[30] Foreign Application Priority Data

Feb. 9, 1979 [DE] Fed. Rep. of Germany ..... 2705348

[51] Int. Cl.[2] ..... A41D 21/00; A42B 3/00

[52] U.S. Cl. ..... 2/423; 248/226.5; 403/373; 179/156 R

[58] Field of Search ..... 2/423, 209, 10; 179/156 R; 248/226.4, 226.5, 316 D; 24/255; 403/373

[56] References Cited

U.S. PATENT DOCUMENTS

| | | | |
|---|---|---|---|
| 1,608,171 | 11/1926 | Hermann | 248/226.5 X |
| 3,913,187 | 10/1975 | Okuda | 24/255 R |
| 3,946,466 | 3/1976 | Sakai | 2/10 X |

*Primary Examiner*—Peter Nerbun

*Attorney, Agent, or Firm*—W. G. Fasse; D. F. Gould

[57] ABSTRACT

An ear or hearing protection device such as an ear cover may be secured to a helmet and held in a desired position by a support member resting on the helmet and by a holding element reaching around the helmet rim. A tooth or detent connection is operatively interposed between the support member and the holding element.

6 Claims, 7 Drawing Figures

APPARATUS FOR SECURING A HEARING PROTECTOR TO A PROTECTIVE HELMET

BACKGROUND OF THE INVENTION

The present invention relates to an apparatus for securing a hearing protection to a protective helmet. More specifically, the hearing protection is secured to the rim of protective helmets or so-called skull guards with or without a rain gutter or drain.

Devices of the mentioned type are basically known and permit the securing of a hearing protection device to a protective helmet without the need for drilling through the helmet shell. For this purpose different components of the securing mechanism are clamped to the protective helmet, whereby the clamping action is achieved by means of screws.

Prior art securing mechanisms of the type which is of interest in this context are complicated in their structure and expensive in their manufacture.

OBJECTS OF THE INVENTION

In view of the above, it is the aim of the invention to achieve the following objects, singly or in combination:

- to provide an especially simply constructed device for securing of hearing protections to protective helmets;
- the securing device shall have few parts and shall be easy to manufacture as well as convenient in its handling; and
- to provide a securing device which may be used with helmets with or without a rain drain and which is adjustable in its holding position.

SUMMARY OF THE INVENTION

According to the invention there is provided an apparatus for securing a hearing or ear protection means to a protective helmet comprising a support member resting on the protective helmet and holding means reaching around the rim of the helmet. A detent or toothed connection is operatively interposed between the support member and the holding means, which, for example, form a holding bail.

The securing device is mounted to the helmet by sliding the holding bail and the support member toward each other until the detent or toothed connection has established a secure fastening.

According to a further embodiment of the invention it is suggested that the support member comprises a toothed rack with a plurality of teeth and that the holding member has a U-shape cross section whereby one of the legs is also provided with a toothed rack having a plurality of teeth. The detent fastening thus comprises two rows of cooperating teeth arranged on members positioned opposite each other.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
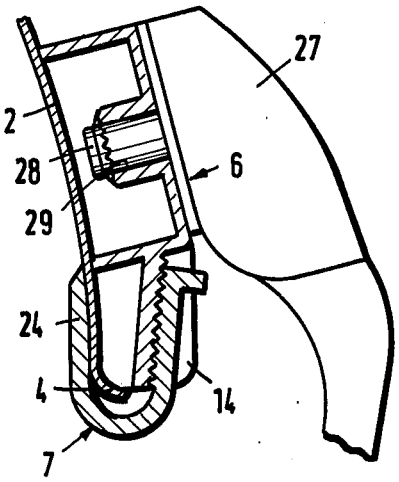
FIG. 1 is a sectional view of a device according to the invention for securing a hearing protection to the rim of a protective helmet.
Figure 2:
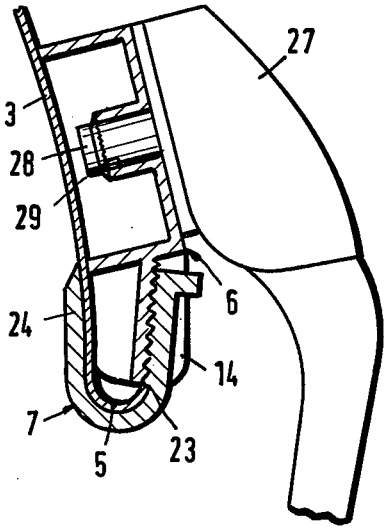
FIG. 2 is a sectional view similar to that of FIG. 1, however, showing a helmet rim provided with a rain gutter or drain.
Figure 3:
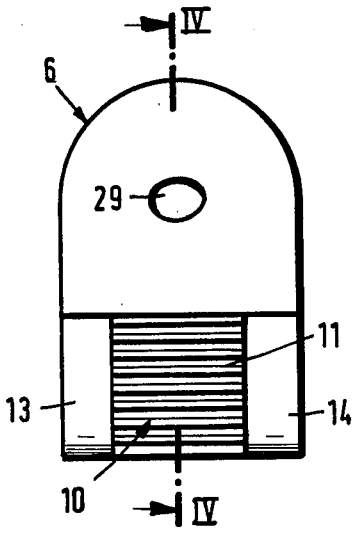
FIG. 3 illustrates a plan view of the support member.

The device according to the invention is suitable for securing a hearing protection such as an ear cover or the like to a protective helmet 2 having a substantially flat rim 4 as shown in FIG. 1 or to a helmet 3 having a rain gutter or drain 5 as shown in FIG. 2. This is an advantage of the invention, because no retooling is required for manufacturing the present device for different types of helmets. The present device comprises a support member 6 and a holding member 7, both of which may be fastened to the helmet 2, 3 and to each other by means of a detent connection.

Figure 4:
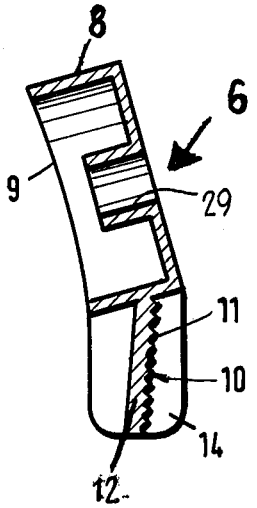
FIG. 4 is a sectional view of the support member along the section line 4—4 in FIG. 3.
Figure 5:
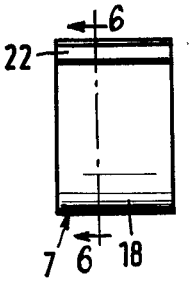
FIG. 5 is a plan view of the U-shaped holding member.
Figure 6:
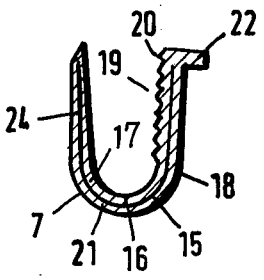
FIG. 6 is a sectional view through the U-shaped holding member along section line 6—6 in FIG. 5.

The support member 6 comprises substantially the shape of a cover 8 shown in FIG. 4. The open rim 9 of the cover 8 has a contour adapted to the outer surface of the protective helmet 2, 3. The support member 6 further comprises a detent or toothed row 10 comprising a plurality of teeth 11 secured to or forming part of a land 12 extending laterally from the support member 8. The land 12 is laterally supported by guide elements 13 and 14. The land 12 and the guide elements 13 and 14 extend away from the cover shaped member 8 of the support member 6. For example, the land 12 and the guide elements 13 and 14 may form an obtuse angle relative to the cover portion 8 of the support member 6 as shown in FIG. 4. The holding member 7 has a U-shaped cross section as best seen in FIGS. 1, 2 and 6. Both the holding member 7 and the support member 6 are made of synthetic material such as polyvinyl chloride. The holding member 7 comprises an insert or reinforcement 15 made of spring steel and also having a U-shape. The reinforcement 15 is inserted into a U-shaped recess 16 in the holding member 7. The reinforcement 15 in the recess 16 is covered by means of a cover 17 shown in FIG. 6. If desired, the holding member 7 and the cover 17 may be manufactured as an integral unit, whereby the reinforcement spring steel member 15 is embedded in the holding member 7 as shown in FIG. 6.

One leg 18 of the holding member 7 also comprising a tooth row 19 with a plurality of teeth 20 operating as a detent for the teeth 11 on the land 12.

The web or cross piece 21 of the holding member 7 which interconnects the legs 18 and 24 of the holding member 7 is rounded and adapted to the contour of the flat, tapering rim 4 of the protective helmet 2 or to the contour of the rain gutter 5 of the protective helmet 3. The free end of the leg 18 is provided with a handle member 22 for removing the holding member.

The device 1 is secured to a protective helmet 2, 3 as illustrated in FIGS. 1 and 2. Thus, the lateral guide elements 13 and 14 of the support member 6 rest with their lower end on the flat, tapering rim 4 or on the free rim 23 of the rain gutter 5. Further, the holding member 7 reaches around the rim 4 or around the rain gutter 5 of the protective helmet 2, 3, whereby one leg 24 rests against the inner surface of the helmet 2, 3, whereas the other leg 18 rests with its teeth 20 on the teeth 11 of the support member 6.

Figure 7:
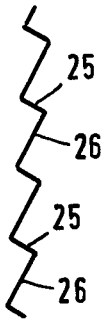
FIG. 7 illustrates, on an enlarged scale, the tooth flanks on the support member or on the holding member.

The shape of the teeth 11, 20 including their flanks or the angles of the flanks is selected in such a manner that the holding member 7 is easily slidable onto the support member 6, that is in an upward direction as shown in FIGS. 1 and 2. Simultaneously the teeth intermesh in such a manner that it is hard to pull the holding member 7 off the support member 6 in a downward direction as seen in FIGS. 1 and 2. For this purpose the two flanks 25, 26 of each tooth are slanted in different directions as illustrated in FIG. 7.

When assembling the device the holding member 7 is pushed with its tooth rack 19 to such an extent onto the tooth rack 10 of the support member 6 that a secure and rigid connection is established.

The releasing of the fastening or holding member 7 said grip 22 and with it the leg 18 may be lifted off the land 12, whereby the toothed racks 10, 19 are disengaged from each other for easy removal.

The hearing protection or rather a bail 27 carrying the hearing protection is suitably secured to the support member 6. For this purpose a stud 28 may be used as illustrated in FIGS. 1 and 2. The stud 28 fits with a snug fit into a bore 29 in the support member 6.

Incidentally, the reinforcement 15 of spring steel has such a bias that the teeth 11 and 20 are urged against each other.

The invention is not limited to the specific embodiment illustrated in the figures. Rather, it is possible to make changes without departing from the basic teaching of the invention. Thus, it will be appreciated, that it is intended to cover all modifications and equivalents within the scope of the appended claims.

What is claimed is:

1. An apparatus for securing a hearing or ear protection means to a protective helmet having a rim, comprising a support member (6) for said protection means (27), said support member resting on the protective helmet, separate U-shaped holding means (7) reaching around the rim of the helmet, said support member comprising a land with a first row of detent connection means (11) facing substantially outwardly, said U-shaped holding means having a second row of detent connection means (20) facing substantially inwardly for cooperation with said first row of detent connection means whereby said first and second row of detent connection means are operatively interposed between the support member and the holding means for releasably engaging and disengaging the support member and the holding means.

2. The apparatus of claim 1, wherein said land of said support member extends away from said support member, said support member further comprising lateral guide elements (13, 14) which support said land (12).

3. The apparatus of claim 1, wherein said hearing or ear protection means comprise bail means, and means for securing said bail means to said support means.

4. The apparatus of claim 1, wherein said U-shaped holding means is made of a synthetic material, said holding means further comprising a biasing spring steel means (15) also bent into a U-shape and enclosed in said synthetic material of said holding means.

5. The apparatus of claim 4, wherein said holding means comprises a U-shaped recess for receiving said spring steel means, and a cover (17) for said spring steel means.

6. The apparatus of claim 1, wherein each of said teeth has two teeth flanks, each flank having an inclination that differs from the inclination of the other tooth flank.

* * * * *

UNITED STATES PATENT OFFICE
CERTIFICATE OF CORRECTION

Patent No. 4,167,043 Dated September 11, 1979

Inventor(s) Guenter Hartig

It is certified that error appears in the above-identified patent and that said Letters Patent are hereby corrected as shown below:

In Item [73]:

--[73] Assignee: OPTAC Wilfrid Weltin
Roedermark-Ober Roden
Federal Republic of Germany--;

In Item [30]:

--[30] Foreign Application Priority Data
Feb. 9, 1977 [DE] Fed. Rep. of Germany...2705348--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*